US005598950A

United States Patent [19]

Liu et al.

[11] Patent Number: 5,598,950

[45] Date of Patent: Feb. 4, 1997

[54] TOY FOR EJECTING A STREAM OF CHILLED WATER

[75] Inventors: Dexter C.-T. Liu, Portsmouth; David Weindel, East Greenwich, both of R.I.; Peter Cooper, Gramby, Conn.

[73] Assignee: LCD International, L.L.C., Newport, R.I.

[21] Appl. No.: 662,888

[22] Filed: Jun. 13, 1996

Related U.S. Application Data

[63] Continuation of Ser. No. 292,440, Aug. 18, 1994, abandoned.

[51] Int. Cl.[6] ..... A63H 3/18

[52] U.S. Cl. ..... 222/79; 222/146.6; 222/207; 222/209; 222/380

[58] Field of Search ..... 222/79, 146.6, 222/207, 209, 324, 380, 381; 446/405, 473; 124/64, 65, 70

[56] References Cited

U.S. PATENT DOCUMENTS

| | | | |
|---|---|---|---|
| 209,660 | 11/1878 | Condict et al. | 222/381 |
| 1,651,612 | 12/1927 | McDonald et al. | 222/146.6 X |
| 1,732,996 | 10/1929 | Wandel | 222/146.6 X |
| 2,707,579 | 5/1955 | Vincent | 222/324 X |
| 2,824,672 | 2/1958 | Wersching | 222/207 |
| 4,743,030 | 5/1988 | Auer et al. | 273/349 |
| 4,765,510 | 8/1988 | Rende | 222/79 |
| 4,784,293 | 11/1988 | Hiroshi | 222/381 X |
| 5,052,587 | 10/1991 | Graves | 222/79 |
| 5,150,819 | 9/1992 | Johnson et al. | 222/79 |
| 5,256,099 | 10/1993 | Rudell et al. | 446/473 |
| 5,305,919 | 4/1994 | Johnson et al. | 222/79 |

*Primary Examiner*—Joseph Kaufman

*Attorney, Agent, or Firm*—Panitch Schwarze Jacobs & Nadel, P.C.

[57] ABSTRACT

A water toy that ejects a stream of water under pressure and in one embodiment is particularly suited to serve as a water-sword toy and in another embodiment to serve as a pump-action water gun toy is disclosed. In both embodiments, the water toy includes a wide mouth reservoir that accepts ordinarily available ice cubes which cooperate with water so that chilled water is emitted, under pressure, which may have some soothing benefits, especially during hot summer conditions. The water-sword toy not only emits water upon contact of its tip by an object, but also has provisions for emitting water out of its tip without contacting any object. The pump-action water gun toy has provisions to provide for a straight or spread water trajectory so as to simulate a rifle-water toy or a shotgun-water toy.

18 Claims, 8 Drawing Sheets

TOY FOR EJECTING A STREAM OF CHILLED WATER

This application is a continuation of Ser. No. 08/292,440 filed Aug. 18, 1994, now abandoned.

FIELD OF THE INVENTION

This invention relates generally to liquid-filled game toys and, more particularly, to a toy that ejects a stream of chilled water under pressure and is particularly suited to serve as a water-sword toy or a pump-action, water-gun toy.

BACKGROUND OF THE INVENTION

Water filled game toys are well known and are appealing to children, especially, in the summer time or during other hot weather conditions. The water-filled game toys have various configurations, some of which are shaped to simulate toy weapons, such as a water-sword toy disclosed in U.S. Pat. No. 5,256,099 ('099) of Rudell et al, or of a water-gun toy disclosed in both U.S. Pat. Nos. 4,765,510 ('510) and 4,743,030 ('030).

The '099 patent of Rudell et al is herein incorporated by reference and discloses a water-sword toy having a graspable handle from which extends a cylinder having a soft material thereon serving as an innocuous blade portion of the toy. The blade portion has a tip which, when placed into contact with a game participant, ejects a pressurized fluid, such as water, therefrom. The toy of the '099 patent serves well its intended purpose, but does not have any provisions for ejecting chilled water under pressure. The ejection of chilled water might very well have refreshing benefits, especially on a hot summer day. Further, the toy of the '099 patent is limited to only ejecting water by physically contacting an object, such as a game participant. As is known, children have a propensity or delight for ejecting water and a toy that requires the presence of another participant or a stationary object in order to eject water presents a drawback.

Water-gun toys of the '030 and '510 patents also lack the provisions for ejecting a stream of chilled water. Further, the repertoire of simulated water weapons disclosed in the '030 and '510 patents is limited in that the disclosed water pistols do not include pump-action water toys which recently have become quite popular. For example, a pump-action water rifle has the advantage of ejecting a stream of water for a relatively long distance, as compared to that occurring for a typical prior art water pistol. The increased trajectory may be beneficial in games that children play. Further a pump-action water shotgun, not disclosed in the '030 and '510 patents has the advantage of ejecting a spray type trajectory of water which is beneficial in hot weather. Both of the advantages of pump-action water toys are further enhanced by the ejection of a chilled stream of water.

Prior art indicated by the aforementioned references, describing water-filled toys that eject a stream of water, seem to be limited in that none of the disclosed devices have the ability to eject a stream of chilled water under pressure. More particularly, none of the disclosed water-filled toys have the ability to accept ice cubes which may be used as a source to coact with ordinary water in order to allow the water-filled toys to eject chilled water under pressure. The present invention provides water-filled toys that eject, under pressure, a stream of chilled water which has soothing benefits to the recipient thereof, especially on a hot summer day. Water toys in accordance with the present invention have a relatively wide mouth that accepts the insertion therein of ordinarily sized ice cubes and later allows for residue liquid therein to be easily drained therefrom. Such water toys are easily constructed by having some major parts snapped together, thereby, facilitating assembly. In one embodiment, the present invention comprises a water toy, simulating a toy sword that has provisions for ejecting water without the need of physically contacting an external object.

SUMMARY OF THE INVENTION

Briefly stated, the present invention comprises a water toy for ejecting a stream of water under pressure. More specifically, the present invention is an improvement to such a water toy comprising a reservoir having an opening with a first mouth sufficiently wide to accept ordinary sized ice cubes. A first cap is releasably secured within the reservoir to close off the opening. The reservoir is also capable of holding water. In one embodiment, the water toy comprises a sword and in another embodiment the water toy comprises a water gun. Means are provided on the water gun for changing the trajectory of water ejected therefrom from a relatively tight stream simulating the trajectory of a water rifle to a dispersed or scattered stream simulating the trajectory of a water shotgun.

BRIEF DESCRIPTION OF THE DRAWINGS

The foregoing summary and the following detailed description of preferred embodiments of the invention will be better understood when read in conjunction with the appended drawings. Although preferred embodiments are shown in the drawings, it should be understood that the invention is not limited to the precise arrangements and instrumentalities shown in the drawings, which are all diagrammatic. In the drawings.

DETAILED DESCRIPTION OF THE PREFERRED EMBODIMENTS

Figure 1:
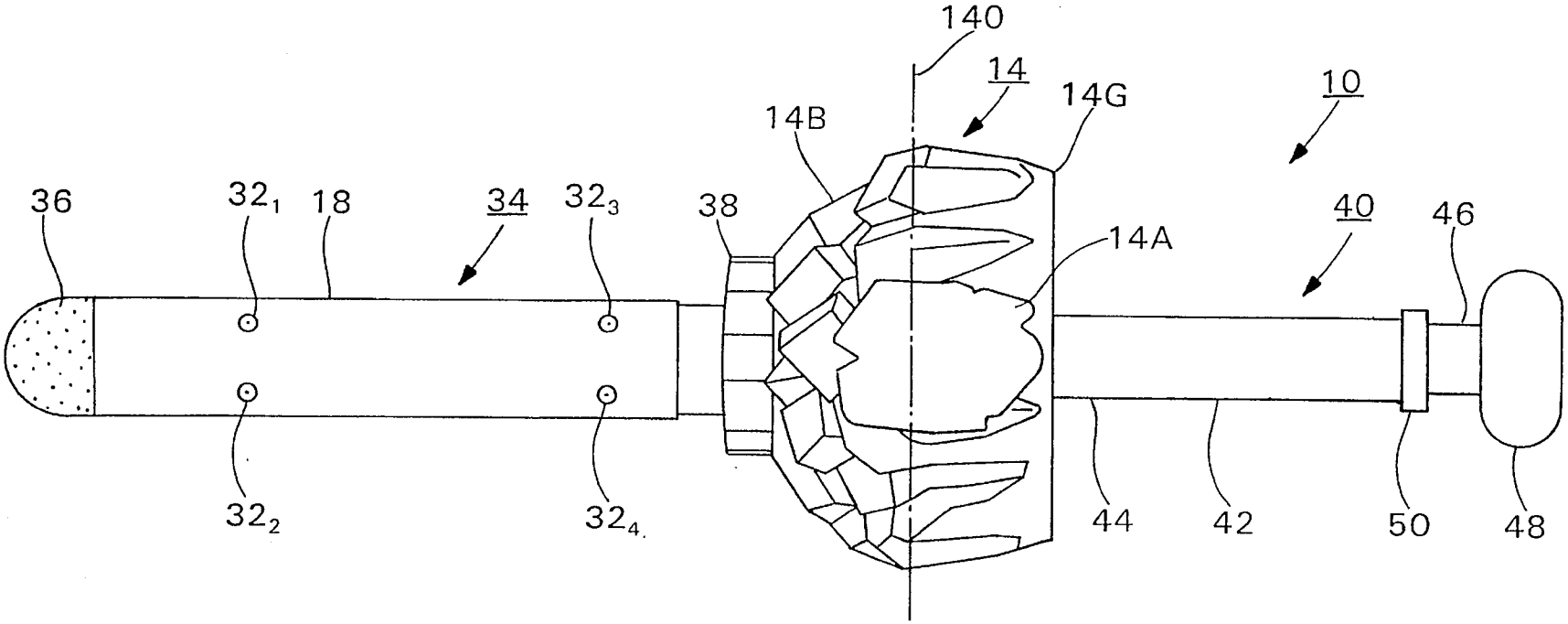
FIG. 1 is a top plan view illustrating one embodiment of the present invention which is particularly suited to serve as a water-sword toy.
Figure 2:
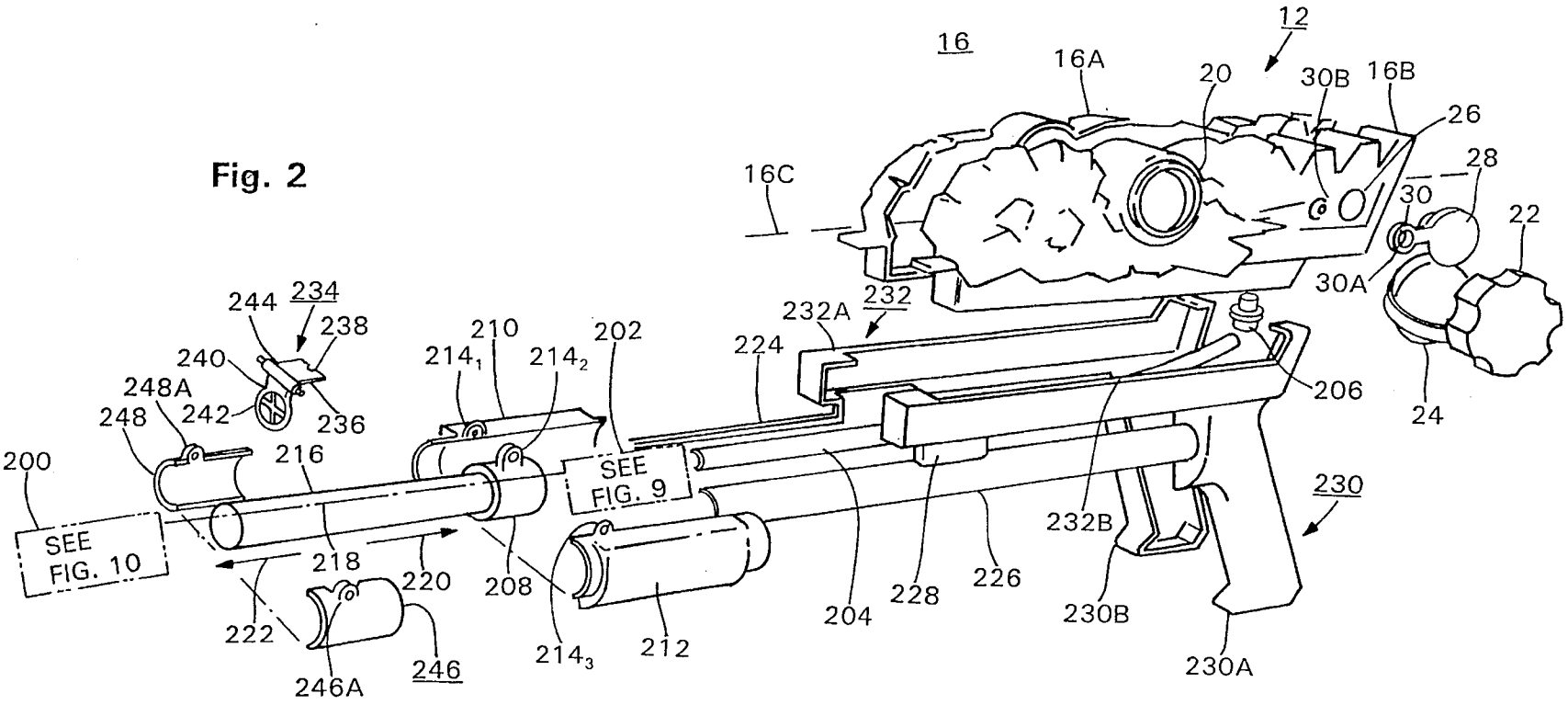
FIG. 2 is a perspective view of another embodiment of the present invention which is particularly suited to serve as a pump-action water toy.

In the drawings, like numbers are employed for the indication of like elements throughout the figures. Referring to the drawings, in particular, to FIGS. 1 and 2 there is shown in FIG. 1 a water toy 10 particularly suited to serve as a water-sword toy and, in FIG. 2, there is shown a water toy 12 particularly suited to serve as a pump-action water toy having the configuration of a rifle or a shotgun dependent upon the positioning of an aiming device to be described. The water toy 10 has a relatively wide mouth reservoir 14 serving as a hilt of the water-sword toy and preferably having a relatively flat region 14A which serves as a surface for placing an identification label of the owner of the sword 10. The reservoir 14 may comprise two separate halves 14B and 14C that are brought together in a sealing manner so that the reservoir 14 may be sufficiently sealed to hold water therein under pressure. Similarly, the water toy 12 has a wide mouth reservoir 16 which may be formed of separate pieces 16A and 16B that are adhesively joined together but need not be sealed in such a manner to hold water under pressure.

The water sword 10 has a front portion, as viewed in FIG. 1, that carries a foam housing 18 which is typically constructed from a molded closed cell form and allows the front portion to act as an innocuous blade portion for the water-sword toy 10. All of the other elements of toy 10 and also toy 12, unless otherwise noted, are typically constructed from a relatively rigid polymeric material such as a high impact styrene, polyethylene or polypropylene.

Both toys 10 and 12 accept ordinarily sized ice cubes into their wide mouth reservoir so that the ice may coact with ordinary water to allow, as to be further described, each of the toys 10 and 12 to eject, under pressure, a chilled stream of water. More particularly, with reference to FIG. 2, and later with reference to FIG. 3 to be described, there is shown a wide mouth opening 20 of water toy 12 which is dimensioned so as to have its diameter accommodate the acceptance of three ranges of ice cubes, with the first range having a diameter of about one inch so as to accept the smallest ordinarily available ice cubes. The second range has a diameter of about one and one-half inches so as to accept the most commonly available ice cubes. The third range has a diameter of about two inches to accept substantially all available ice cubes. A first cap 22, having a flap 24, is releasably secured with the reservoir so as to close off the opening 20. The reservoir 16 preferably has a second opening 26, which is used to insert ordinary water, that is smaller than the opening 20 and which is provided with a second cap 28 having an end 30 with an aperture 30A therein that is used to frictionally mate with a complementary protrusion 30B of the reservoir 16 so as to close off the second opening 26. The openings 24 and 26 are not sealed so that ambient pressure may find its way into the reservoir 16. Conversely, the reservoir 14 of the toy 10 of FIG. 1 is sealed to the ambient so that its interior may maintain the water therein under pressure.

In general, the water toy 10 comprises a nozzle fluidly coupled to the reservoir, a valve between the nozzle and the reservoir, and a pump fluidly coupled with the reservoir so as to pressurize the reservoir. The water toy 10 has the foam portion 18 attached by conventional fasteners $\mathbf{32}_1$, $\mathbf{32}_2$, $\mathbf{32}_3$, and $\mathbf{32}_4$ to the, previously mentioned, innocuous blade portion thereof now indicated by reference number 34. The blade portion 34 has a tip 36 on its outermost forward end. The blade portion 34 is preferably attachable to the first end of the reservoir by means of a screwable cap 38 having a sealing member (not shown) therein. The second side of reservoir 14 has a pump mechanism 40 comprising an outer cylinder 42 that is mated to the second side of reservoir 14 preferably by means of a housing member 44. The pump mechanism 40 further comprises an inner cylinder 46 having a grippable device 48 on one of its ends. The outer cylinder 42 is separated, preferably by means of a collar member 50, from the inner cylinder 46 so as to provide a first gap therebetween.

Figure 3:
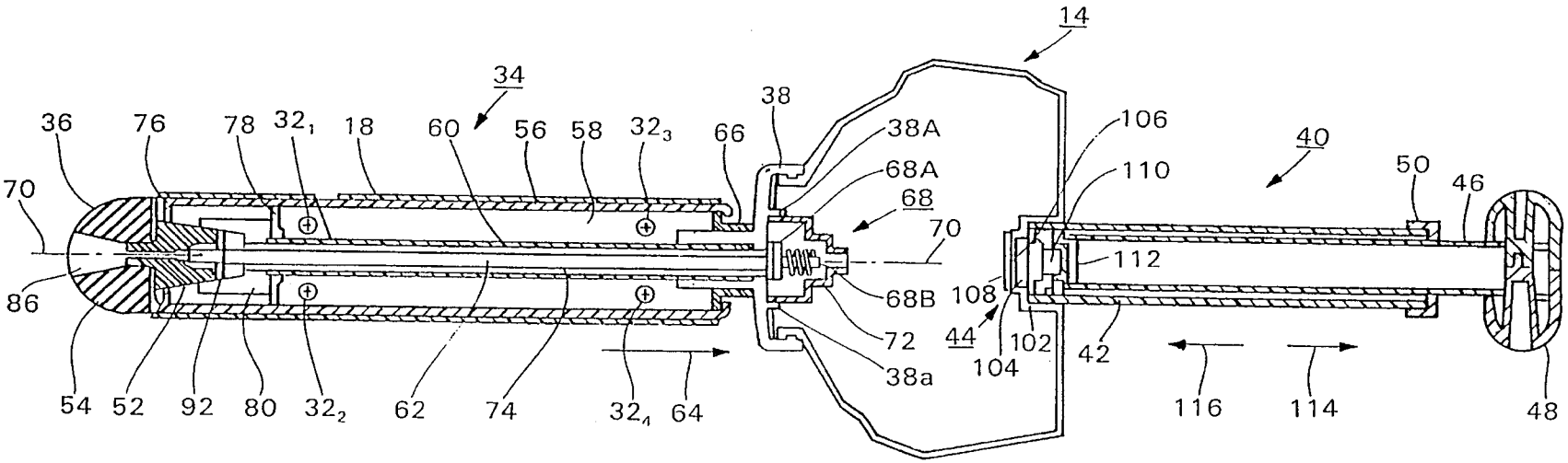
FIG. 3 is a sectional view of the water-sword toy of FIG. 1.

As seen in FIG. 3, the front end of the blade portion 34 lodges a nozzle 52 as well as the tip 36 comprising a porous material 54 that flexes somewhat when encountering an object, such as an individual participating in a game that uses the water-sword toy 10. The blade portion 34 further comprises an outer cylinder 56 having a bore 58 with a predetermined diameter, an inner cylinder 60 having a bore and situated within the bore 58, and a cylindrical rod 62 situated within the bore of cylinder 60.

The outer cylinder 56 has first and second open ends with the first end movable, in a first direction 64 toward a first side of the wide mouth reservoir 14 by being guided over a connection member 66 which, in turn, is coupled to the first side of the reservoir 14. The connection member 66 is physically joined to the outer face of the removable cap 38 having an opposite face on which is mounted a valve assembly 68.

The valve assembly 68 comprises a stopper 68A preferably having a rubber face serving as a valve and that cooperates with a bias member 68B, preferably of a spring arrangement having one end fixed to the shaft holding the rubberized valve 68A in position. The valve assembly 68 is centrally positioned preferably along the centerline 70 of the reservoir 14 which is also the centerline of the blade portion 34, as shown in FIG. 3. The valve assembly 68 is preferably located within a bracket member 72. The valve assembly 68 is operatively arranged within the bracket member 72 so that the rubberized valve 68A, is movably positioned to be in and out of contact with the first end of the cylindrical rod 62. More particularly, the rubberized valve 68A is biased into a closed position by the spring force supplied by the bias member 68B so as to prevent fluid communication between the first end of the cylindrical rod 62 and the interior of reservoir 14 and, conversely, as is to be described, is movable into an open position when the first cylindrical rod 62 is moved in the first direction 64 by a sufficient amount, also to be described, to overcome the spring bias of the bias member 68B and move away from the first end of the cylindrical rod 62. When the rubberized valve 68A moves away from the first end of the cylindrical rod 62, fluid from the reservoir 14 enters passageway 74 which is formed by the gap between the cylindrical rod 62 and the inner cylinder 60. The passageway 74 extends from the reservoir 14 to the front end of the blade portion 34.

As seen in FIG. 3, the front end of the blade portion 34, in particular the front end of the outer cylinder 56, has a protruding ledge or flange 76 that extends inward from its bore 58, whereas the bore 58 confines another inwardly protruding flange 78. The flange 76 has the nozzle 52 attached thereto, whereas the flange 78 preferably has a guide member 80 attached thereto, as well as one end of the inner cylinder 60. The mounting of the nozzle 52, the guide member 80 and the inner cylinder 60 may be further described with reference to FIG. 4.

Figure 4:
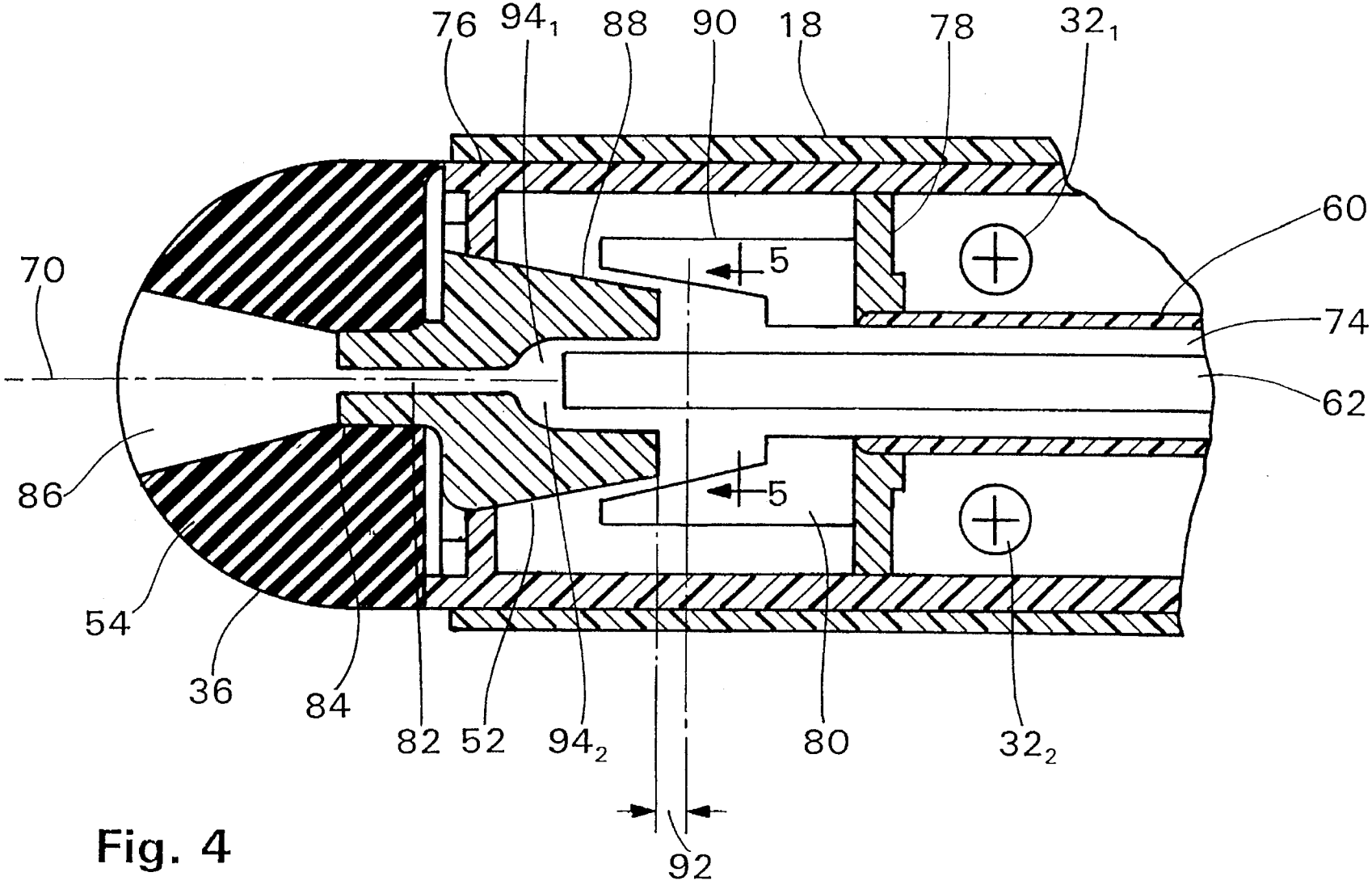
FIG. 4 is a greatly enlarged view which illustrates further details of the front end of the water-sword toy of FIG. 3.

As seen in FIG. 4, the nozzle 52 is attached to flange 74 and is also attached to the tip 36. Further, the nozzle 52 has a passageway 82 that has an exit portion 84 in registry with a channel 86 of the tip 36 that runs from the inner surface of tip 36 to the outer surface thereof. As further seen, the nozzle 52 has a second end 88, preferably tapered, and which mates, in a complementary manner, with a second end 90 of the guide member 80. The nozzle 52 and guide member 80, in their at-rest positions, are separated by a distance 92. The nozzle 52, in particular its second portion 88, is connected to the second end of the cylindrical rod 62 and which connection, in one embodiment, may be further described with reference to FIG. 5.

Figure 5:
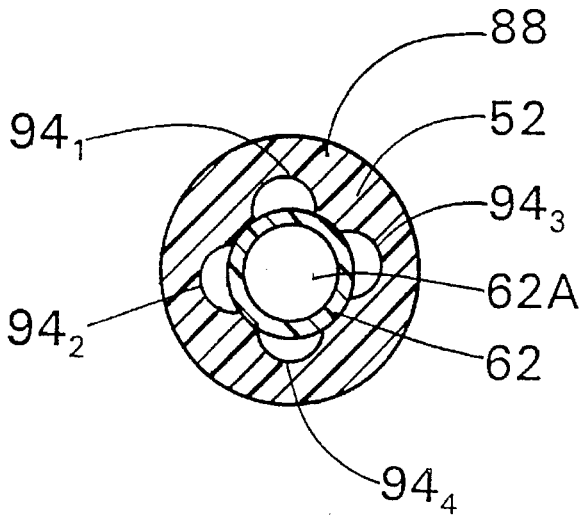
FIG. 5 is a sectional view, taken along the line 5—5 of FIG. 4 illustrating further details of the nozzle and cylindrical rod of the toy shown in FIG. 4.

As seen in FIG. 5, the cylindrical rod 62 may have a hollow 62A and is encompassed by the nozzle 52. As further seen in FIG. 5, the connection between the cylindrical rod 62 and the nozzle 52 is broken by a plurality of passageways $94_1$, $94_2$, $94_3$, and $94_4$. These passageways $94_1$, $94_2$, $94_3$, and $94_4$ direct fluid around the cylindrical rod 62 and into the passageway 82 of the nozzle 52. More particularly, these passageways $94_1$, $94_2$, $94_3$, and $94_4$ serve as a fluid directing device that is in registry between the entrance portion of the nozzle 52 and passageway 74. The fluid directing function performed by the fluid direction device of the embodiment of FIG. 5 may be further described with reference back to FIG. 4.

As seen in FIG. 4, the fluid directing passageways $94_1$ and $94_2$ ($94_3$ and $94_4$ not shown) are in registry between the entrance portion of the passageway 82 of the nozzle 52 and passageway 74. The fluid directing passageways $94_1$ and $94_2$ allow for fluid communication between passageway 74 and passageway 82 which, in turn, allows for the fluid within the reservoir 14 (under control of the valve assembly 68 of FIG. 3) to exit the water-sword toy 10 by way of the channel 86 of tip 36. It should be noted, and as will be further described, that such fluid communication is established when the second end 88 of the nozzle 52 is mated with the second end 90 of the guide member 80. An alternative embodiment for the fluid directing device may be further described with reference to FIG. 6.

Figure 6:
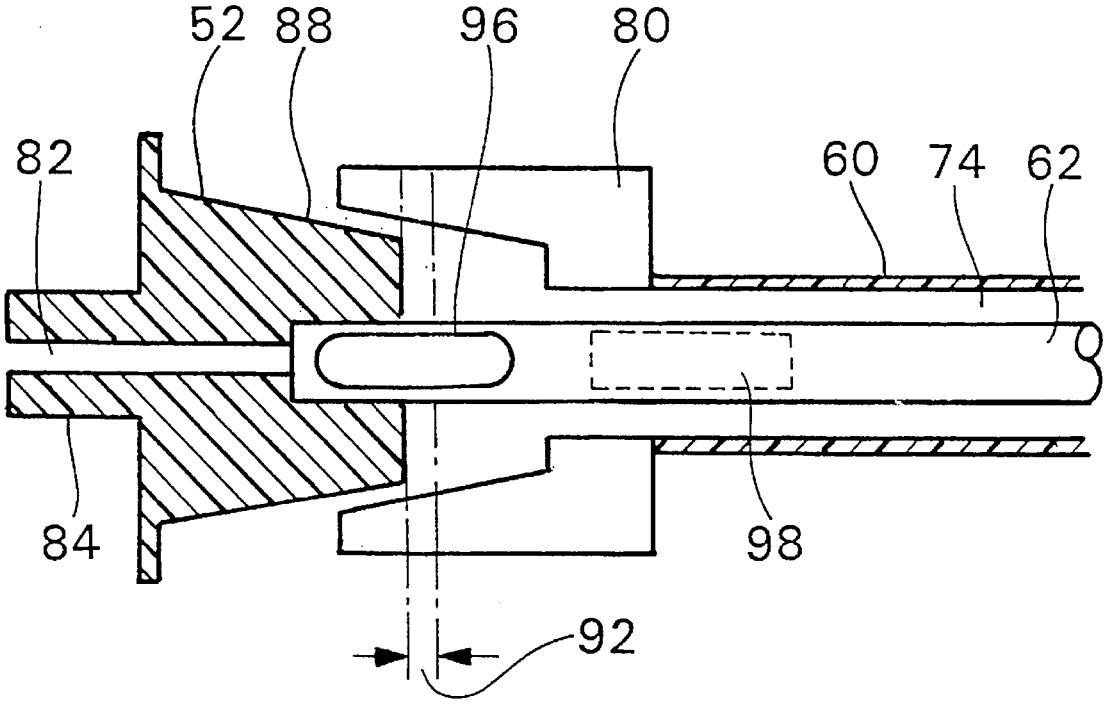
FIG. 6 is an enlarged sectional view which illustrates in an alternate embodiment for directing water to the tip of the water-sword toy of FIG. 1.

Unlike that of FIG. 5, the embodiment of FIG. 6 has the cylindrical rod 62 completely embedded and encompassed by the nozzle 52. The fluid directing device of FIG. 6 is provided by an opening 96 in the cylindrical rod 62 which leads into another opening (not shown) at the second end of the cylindrical rod 62 that, in turn, leads into the passageway 82 of the nozzle 52. Further, it is preferred that a plug 98 be embedded in the bore of the cylindrical rod 62 so that water entering into opening 96 does not find its way up to the first end of the cylindrical rod 62 inserted into the reservoir 14. As can be seen in FIG. 6, the water in passageway 74 flows into the opening 96 which, in turn, flows into the passageway 82 which, in turn, flows into the channel 86 (not shown) of tip 36 (not shown). A further embodiment of a fluid directing device may be further described with reference to FIG. 7.

Figure 7:
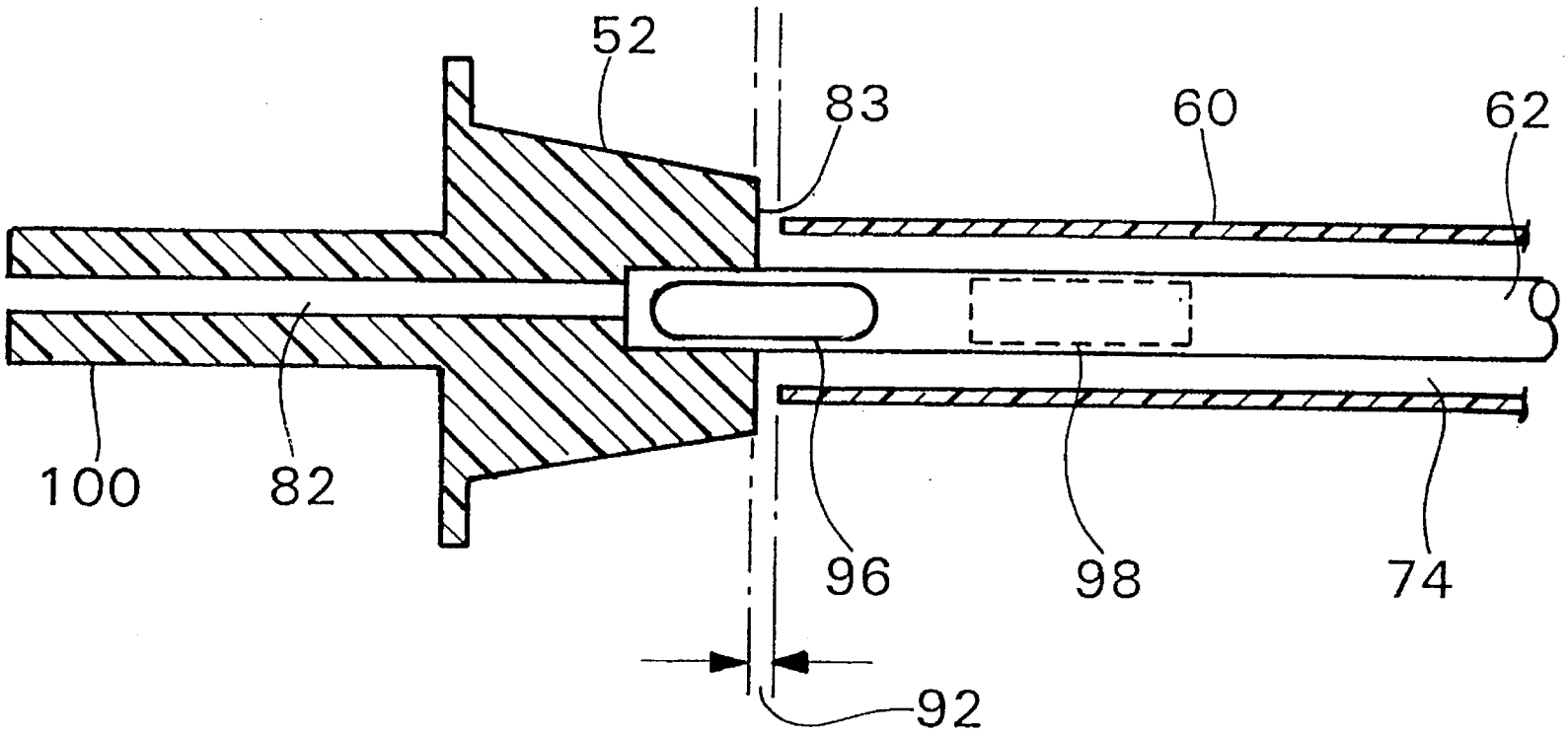
FIG. 7 is an enlarged sectional view illustrating a further embodiment for directing water to the tip of the water-sword toy of FIG. 1.

Unlike the embodiments of FIGS. 3, 4, 5 and 6, the fluid directing device of FIG. 7 has no need of a guide member 80. Instead, nozzle 52 has an extended neck portion 100 and a second end 83 which is contoured to mate with and abut against the open end of cylinder 60 after the nozzle 52 has been moved inwardly by a distance which exceeds the distance 92, to be described. In this arrangement, the water stored in reservoir 14 (under control of valve assembly 68) flows from the passageway 74 into the opening 96 of the cylindrical rod 62 which leads into an opening (not shown) at the second end of cylindrical rod 62 which, in turn, leads into the passageway 82 of the nozzle 52 which, in turn, flows into the channel 86 of the tip 36. The operation of the water-sword toy 10 for ejecting chilled water under pressure may be further described with reference back to FIG. 3.

As previously discussed, the embodiment illustrated in FIG. 3 incorporates the embodiments of FIGS. 4 and 5. More particularly, the embodiment of FIG. 3 includes a guide member 80 that is separated from the nozzle 52 by a distance 92, when the nozzle 52 is in its at-rest position. Further, although not indicated, the nozzle 52 incorporates the fluid directing passageways $94_1$, $94_2$, $94_3$ and $94_4$. In operation, when the water-sword toy 10 is moved so that its tip 36 encounters an object, the contact thereof exerts an inwardly directed pressure which causes the outer cylinder 56 to move in a direction 64 toward the reservoir 14. Such movement carries along with it the nozzle 52. When the nozzle 52 has moved by a distance which exceeds distance 92 separating itself from the guide member 80, it then encounters the guide member 80 forming a water tight closure therebetween. Simultaneously, the movement of the nozzle 52 also carries along with it the cylindrical rod 62 which, in turn, pushes against the rubberized valve 68A in such a manner as to overcome the inward bias provided thereto by the bias spring member 68B. When such a bias is overcome, fluid within the pressurized reservoir 14 flows under pressure into passageway 74, through the nozzle 52 and through the channel 86 so as to be emitted as pressurized chilled water onto the encountered object. It should be noted that distance 92, which limits the inward travel of nozzle 52 and thus cylindrical rod 62, may be selected to limit the amount of water to be ejected at any one time, more particularly, the rate of flow of the chilled water that leaves reservoir 14 and flows into passageway 74. This distance 92 may also be selected so as to determine the amount of chilled water emitted as bursts from the tip 36.

Further, as can be seen in FIG. 3, if the blade portion 34 is grasped and moved in direction 64, such a movement, in and of itself without any encountering of an object, causes the cylindrical rod 62 to encounter the rubberized valve 68A in such a manner to overcome the bias provided thereto by bias member 68B and, thereby, allowing the pressurized water within the reservoir 14 to be ejected, in a pressurized manner, outwardly from the tip 36. The water within the reservoir 14 is preferably chilled by the insertion therein of ice cubes and which chilled water has a somewhat refreshing feeling, especially in the summer hot months. The ejection of the pressurized water, without the need of encountering an object, may be conveniently continued by an operator grasping the blade portion 34 and also the pump mechanism 40, and manipulating elements 34 and 40 in a pump-action manner. The operator need only move the blade portion 34 in direction 64 to allow for the ejection of the pressurized chilled water. The pressurization of the water within reservoir 14 is accomplished by means of the pump mechanism 40.

As previously mentioned, the pump mechanism 40 includes the outer cylinder 42 having a bore with a predetermined diameter and first and second ends with the first end connected to the second side of the wide mouth reservoir 14 by means of a housing member 44 having an outer surface in communication with the fluid within the reservoir 14. If desired, the outer cylinder 42 may be directly connected to the second side of reservoir 14. The housing member 44 has a first cavity 102 which preferably holds the first end of the outer cylinder 42 and a second cavity 104 which, as will be described, serves as a pump chamber. The second cavity 104 has a hole 106 in its central portion over which is placed a one-way valve 108. Another one-way valve 110 is situated in abutment with the first end of the outer cylinder 42 and is connected to the inner cylinder 46 by means of a threadably engageable member 112. The inner cylinder 46 has a bore with an inner wall and is dimensioned so that its first end may be insertable into the bore of the outer cylinder 42. The inner cylinder 46 is movable, in a linear manner, in a first direction 114 away from the first end of the outer cylinder 42 and in a second direction 116 toward the first end of the outer cylinder 42. The movement of the inner cylinder 46 in directions 114 and 116 controls the operation of the first and second one-way valves 110 and 108, respectively, which both may be further described with reference to FIG. 8.

In general, the one-way valves 110 and 108 operate in response to the movement of the inner cylinder 46 in directions 114 and 116 so as to induce the flow of air from the ambient to the wide mouth reservoir 14 by way of a gap between the cylinders 42 and 46 and by way of the first and second one-way valves 110 and 108 respectively. The first one-way valve 110 has a first end 118 located proximate to the first end of the cylinder 42 and having at least one, but preferably more than one opening, such as $\mathbf{120}_1$ and $\mathbf{120}_2$. The one-way valve 110 has a second end 122 connected to the inner cylinder 46 by the threadably engageable member 112. The second one-way valve 108 has a first side that is fluidly coupled to the fluid in the wide mouth reservoir and an opposite second side that is used to establish communication with the first end 118 of the first one-way valve 110. More particularly, the second side of the second one-way valve 108 and the first end 118 of the first one-way valve 110 are spaced apart from each other to form a pump chamber 104, previously mentioned, therebetween which is used to pressurize the chilled water in reservoir 14.

The first one-way valve 110 further comprises at least one carrier 124 located at the periphery of the first end 118. Further, the one-way valve 110 further comprises a middle section 126 that interconnects the first end 118 with the second end 122 thereof. The middle section 126 has a major portion 128 which snugly abuts against the inner wall of the bore of the inner cylinder member 46. The middle section 126 further comprises a minor section 130 that is connected to the first end 118 and has a tapered portion 132 therebetween that forms a blocking flange 134 that fits under the abutting portion of the bore of the inner cylinder 46. The first one-way valve 110 further comprises an O-ring 136 that is positionable between the blocking ledge or flange 134 and the carrier 124. The O-ring 136 is shown to have two operating positions; the first being 136A (shown in phantom) resting on the carrier 124 and the second being 136B (shown in solid) wedged under the blocking flange 134 and in contact with the inner wall of the bore of the outer cylinder 42. The O-ring 136 is preferably of a rubber type and is dimensioned so as to snugly come into contact with the inner wall of the bore of the outer cylinder 42.

The first one-way valve 110 further preferably comprises the first and second ends 118, 122 each having an additional opening 138 and 140, respectively, therein. These additional openings accommodate a pressure release valve comprising a head 142 with a shaft 144 extending therefrom and dimensioned to mate, in a complementary manner, with opening 138. The pressure release valve further comprises a spring 146 having an opening which fits over the shaft 144 has a first end connected to a solid member 148. The solid member 148, also part of the pressure release valve, is connected to the second end 122 proximate to opening 140. The spring 146 preferably has a predetermined spring constant that only allows the head 142 to move away from opening 138 when the pressure in pump chamber 104 exceeds a predetermined limit.

Figure 8:
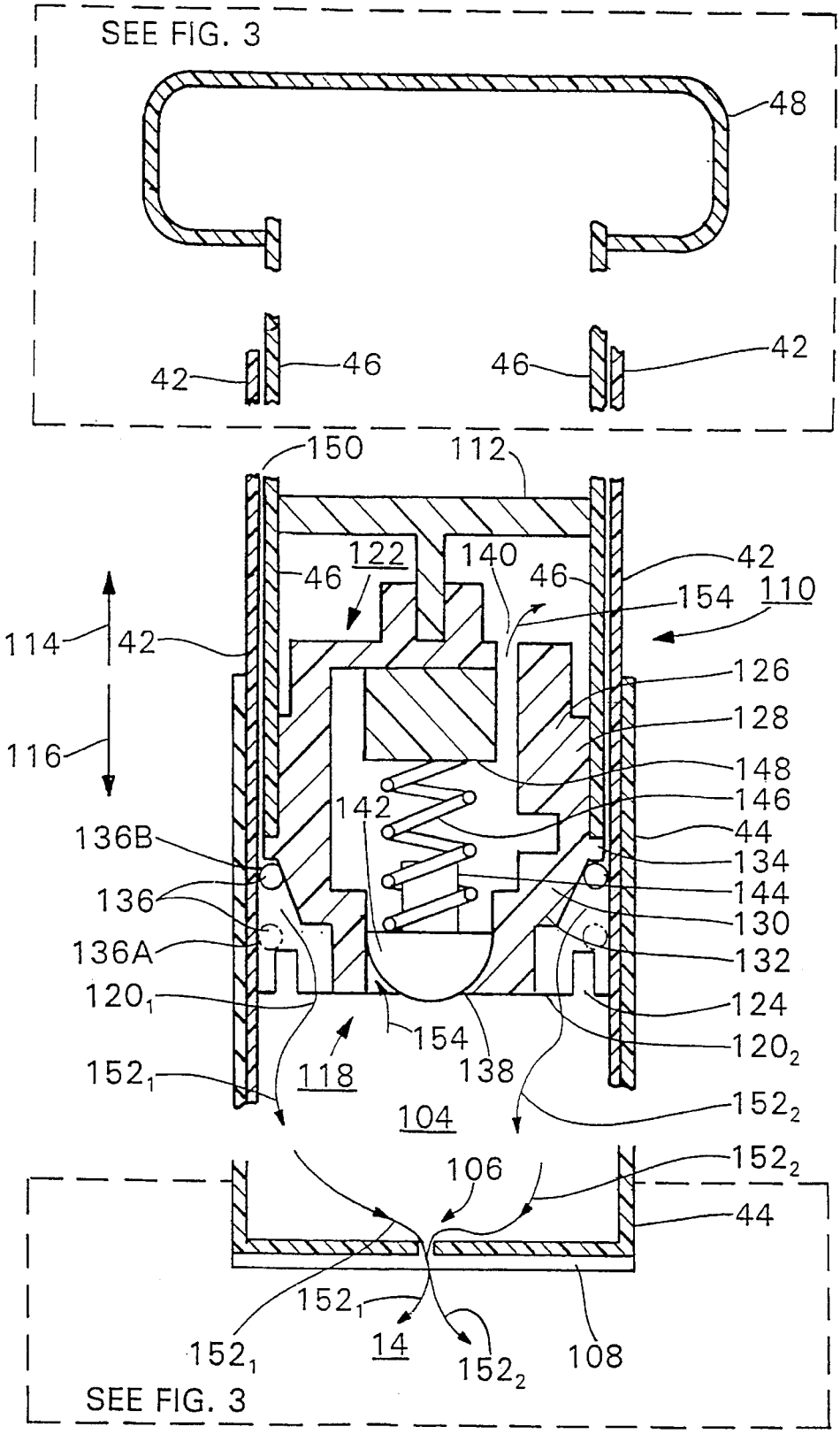
FIG. 8 is an enlarged sectional view which illustrates the one-way valves of the pump mechanism of the toy shown in FIGS. 1 and 3.

In operation, when the inner cylinder 46 is moved in the first direction 114, it causes ambient air to be drawn through the annular gap 150, located (as shown in FIG. 3) between the outer wall of inner cylinder 46 and the inner wall of outer cylinder 42, and into the pump chamber 104. During such movement, the O-ring 136 is resting on the carrier 124 (shown in phantom at 136A) and smoothly riding upward along the inner wall of the bore of the outer cylinder 42. In particular, the O-ring 136 plays a dormant role in the ambient air flowing into the pump chamber 104. Conversely, when the inner cylinder 46 is moved in direction 116, the O-ring 136 engages (as shown by position 136B) the downwardly moving protruding flange 134 and wedges itself therebetween preventing ambient air from further entering the pump chamber 104 so that any further movement of the inner cylinder 46 in direction 116 elevates the pressure of the air already in the pump chamber 104 causing the air therein to become pressurized, thereby, forcing the air past the rubber flapper valve 108 and into the reservoir 14 which, in turn, pressurizes the water therein. The flow of the forced air thus created is shown in FIG. 8 by directional arrows $\mathbf{152}_1$ and $\mathbf{152}_2$.

Further, in the operation of the first one-way valve 110, when the pressure within the pump chamber 104 exceeds a predetermined limit, the excessive pressure therein causes the head 142 of the pressure release valve to move in direction 114 with a force sufficient to overcome the bias force supplied by the spring 146 allowing air from the pump chamber 104, shown by directional arrow 154, to flow through the hole 138 and then out of the one-way valve 110 by way of the relief hole 140 thereby reducing the pressure within the pump chamber 104.

It should now be appreciated that the practice of the present invention provides for a water-sword toy 10 having a configuration to simulate a sword-water toy that ejects, under pressure, a stream of chilled water. This ejection occurs not only when the tip 36 of the sword 12 contacts an object, such as a participant in a game being played, but also when the blade portion 34 is manually moved in direction 64 shown in FIG. 3.

The water gun 12 of the present invention is unlike that of the water-sword toy 10 in that there is no need to pressurize the wide mouth reservoir 16 to provide for an ejection of a steady stream of chilled water, but rather, has a pump-action arrangement for controlling the ejection of a pressurized stream of chilled water. In particular, as seen in FIG. 2, the water gun 12 comprises a tip valve 200 and a piston valve 202 that cooperate with a pump-action arrangement to create suction and pressure cycles to eject the chilled water stored in the non-pressurized wide mouth reservoir 16.

As further seen in FIG. 2, the pump-action water gun toy 12 further comprises a first fluid conduit 204 having a first end connected to the reservoir 16 preferably by way of a tubular connector 206. The first fluid conduit 204 extends from the lower portion of the wide mouth reservoir 16 and has a second end that is at an elevation lower than the first end. The lower elevation assists in the flow of fluid through the first fluid conduit 204. The second end of the first fluid conduit 204 is connected to the first end of piston valve 202. The piston valve 202 has its second end located proximate to a clamping member 208. The clamping member 208 is preferably connected to grippable members 210 and 212 which are interconnected thereto by means of a fastener (not shown) that is insertable to and interconnects complementary openings, such as $\mathbf{214}_1$, $\mathbf{214}_2$, and $\mathbf{214}_3$ respectively located on members 210, 208 and 212. The clamping member 208 allows the gripping members 210 and 212 to assist in the movement of a cylinder 216 also attached to clamping member 208 and having a coaxial centerline 218. The cylinder 216 is manually movable in a first direction 220 toward the reservoir 16 and in a second direction 222 away from the reservoir 16, with both movements preferably being accomplished in a pump-action manner.

The grippable members 210 and 212 are preferably moved along track members 224 and 226, respectively, which are assembled to form a cylindrical member which encases the first fluid conduit 204. The track members 224 and 226 have a first end located proximate to the second end of the first fluid conduit 204. The track members 224 and 226 guide the movement of the cylinder 216 by grippable members 210 and 212, respectively, and each track members 224 and 226 has a stop member 228 (only shown for track 226) for limiting the movement of the grippable members 210, 212 and the cylinder 216 in the first direction 220.

The pump-action water gun toy 12 further preferably comprises a graspable handle member 230 positioned proximate the wide mouth reservoir 16 and located at the second end of the track members 224 and 226. The graspable member 230 may be comprised of two members 230A and 230B which are assembled together.

The water gun toy 12 further comprises a pedestal member 232 having an upper surface adapted to mate with the lower surface of the wide mouth reservoir 16 and a lower surface adapted to mate with the upper surface of graspable handle member 230. The pedestal member 232 may comprise two separate members 232A and 232B which are assembled together. These separable members 232A and 232B, as well as members 230A and 230B and also members 224 and 226, may be joined together with a suitable adhesive in a similar manner as previously described with reference to separable portions 16A and 16B of wide mouth reservoir 16.

The reservoir 16 is located on the rear end of the water gun toy 12 (as viewed in FIG. 2), which has a front end supporting an aiming device 234. The aiming device 234 has a first end 236 with a central cut-out 238 therein and a second end having at least one cross member 240 arranged within an open cylindrical support 242. The aiming member 234 has a cross member 244 with prongs on each end thereof. The prongs are insertable into aperture 246A of member 246 and aperture 248A of member 248.

The members 246 and 248 have complementary edges so that the prongs of aiming member 234 may be inserted into apertures 246A and 248A as the members 246 and 248 are brought together in a snap-lock arrangement. The members 246 and 248 allow the aiming device 234 to be pivotally mounted to the cylinder 216 so as to impose the cross member 240 onto the coaxial centerline 218 when the first end 236 of aiming device 234 is arranged in parallel with the coaxial centerline 218 and, conversely, to allow the cross member 240 to be removed from the coaxial centerline and swung upward to the top (as viewed in FIG. 2) of the bore of the cylinder 216 when the first end 236 is arranged to be perpendicular to the coaxial centerline 218. Such a pivotally mounted aiming device 234 allows the pump-action water gun toy 12 to simulate a rifle when the first end 236 of aiming device 234 is arranged to be perpendicular to the coaxial centerline 216 and, conversely, allows the water gun toy 12 to simulate a pump-action shotgun when the cross member 240 is imposed onto the centerline 218. More particularly, when the cross member 240 is imposed onto the centerline 218, it intercepts and disperses the stream of chilled water being ejected by the water gun toy 12 to provide a spreading trajectory thereof similar to a shotgun and, conversely, when the cross member 240 is moved out of alignment with the centerline 218, the stream of water is maintained intact so that the water gun toy 12 simulates the action of a pump-action rifle having a relatively straight trajectory.

Figure 9:
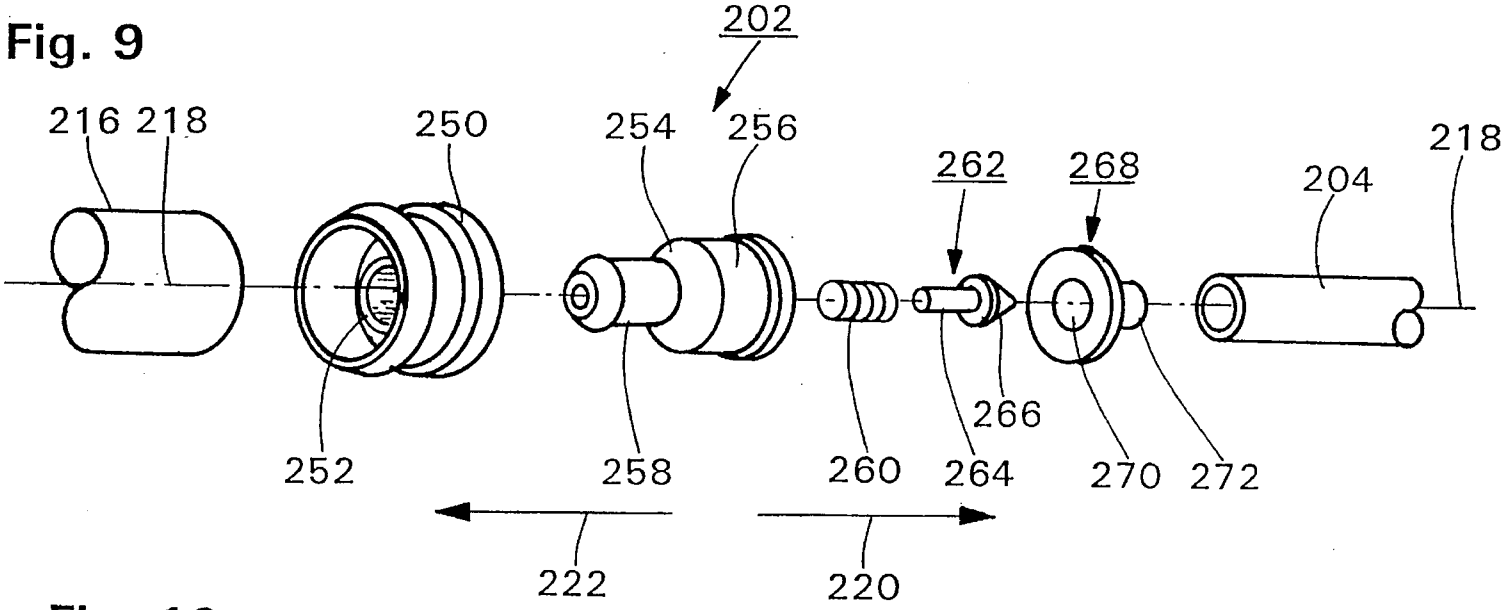
FIG. 9 is an exploded perspective view which illustrates details of the valve piston of the water gun of FIG. 2.
Figure 10:
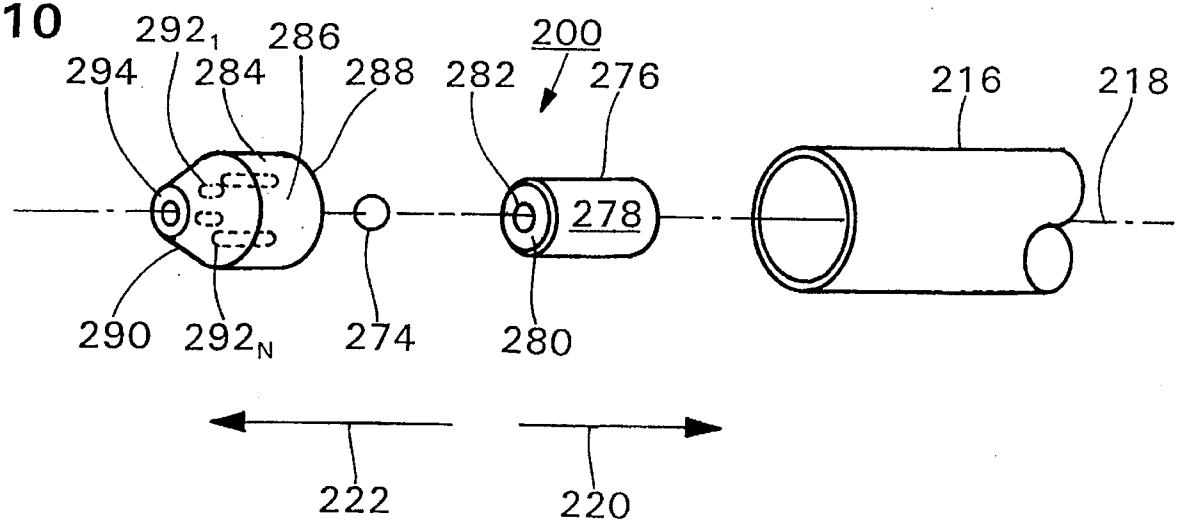
FIG. 10 is an exploded perspective view which illustrates the details of the tip valve of the water gun of FIG. 2.

The development of the suction or partial vacuum and pressurizing cycles of the water that accomplishes the ejection, in a pressurized manner, of the stream of chilled water from the water gun toy 12 is achieved by the tip valve 200 of FIG. 10, in cooperation with the piston valve 202 of FIG. 9. As seen in FIG. 9, the piston valve 202 comprises a member 250 having flexible sidewalls and including a cavity 252, and a member 254 having a chamber 256 and a stem 258. The piston valve 202 further comprises a spring member 260, a valve 262 having a shaft 264 and a conical tip 266 at one end, and a valve seat 268 having a central conical portion 270 that leads into a first end 272 having an opening (not shown) therein which communicates with the first fluid conduit 204.

The piston valve 202 is assembled by first inserting the flexible sidewalls of member 250 into the bore of cylinder 216. Then the stem 258 of member 254 is inserted into the cavity 252, followed by the insertion of the spring 260 into the hollow of the stem 258 which, in turn, is followed by the shaft 264 being inserted into the central opening of spring 260. Next, the seating member 268 is inserted so that its conical portion 270 provides for a seat for the conical tip 266 of the valve 262. Finally, the first end of the valve seat 268 is inserted into the second end of the first fluid conduit 204. The assembled piston valve 202 cooperates with the tip valve 200, which may be further described with reference to FIG. 10.

The tip valve 200 comprises a ball member 274, having a first predetermined diameter, and a first cylindrical member 276 having a hollow 278 with an entrance and an exit portion. The entrance portion has a seating member 280 in which the ball member 274 may rest. The seating member 280 has an opening 282 which is closed off when the ball member 274 is resting therein. The tip valve 200 further comprises a second cylindrical member 284 having an inner chamber 286 with an entrance 288 and exit portion 290 and having at least one cut-out, but preferably multiple cut-outs $292_1 \ldots 292_N$. The exit portion 290 is dimensioned to define an orifice 294 having a second predetermined diameter which is less than the first predetermined diameter of the ball member 274. The cutouts $292_1 \ldots 292_N$ are situated in the inner chamber 288 so that water which passes by the ball member 274 and flows out of the tip valve 200 through the orifice 294 when the ball member 274 is located in the exit portion 290 of the inner chamber 286.

In operation, and with simultaneous reference to FIGS. 2, 9 and 10, when the cylinder 216 is moved in a linear, pump-action manner, in direction 220 preferably with the assistance of the graspable members 210 and 212 (see FIG. 2), the ball member 274 of the tip valve 200 moves into the seat 282 of member 276 (see FIG. 10) causing the second end of the cylinder to be blocked from the flow of air through the orifice 294. After such denial, the continued movement of the cylinder 216 in direction 220 establishes a partial vacuum in chamber 256 (see FIG. 9). Such a partial vacuum allows the valve 262 to have its conical head 266 urged out of the conical seat 270 and, thereby, providing a pressure differential between the second end of the first fluid conduit 204, connected to the first end 272 of valve seat 268, and the reservoir 16 which, in turn, causes the chamber 256 to effectively enlarge and to be filled with water from the reservoir 16. Effective enlargement of chamber 256 is meant to represent that the pressure within chamber 256 is less than ambient which creates a suction effect drawing water thereto.

Movement of the cylinder 216 in direction 222 causes 10 the ball 274 to leave its seat 282 (see FIG. 10) and also causes the effective volume of the chamber 256 to be reduced which creates a pressure to allow the water therein to be expelled through the cylinder 216, and through the tip valve 200 where it exits from the orifice 294. Effective reduction of chamber 256 is meant to represent that the pressure within chamber 256 is greater than ambient which creates a force to expel the water in the chamber 256. It should be noted that movement in direction 220 and then the movement in direction 222 may need to be performed in a rapid manner until the suction and pressure conditions are created so that the water may be ejected, under pressure, in rapidly occurring bursts. The trajectory of the stream of water being emitted under pressure is dependent, in a manner as previously described, upon the position of the aiming device 234.

It should now be appreciated that the practice of the present invention provides for a water-filled toy that simulates a pump-action water gun. The pump-action water toy may either simulate a relatively straight trajectory, such as experienced by the spray of a water rifle, or a more spreadout trajectory, such as experienced by the spray of a water shotgun. Both trajectories provide for the ejection of a chilled water due to the ability of the wide mouth reservoir 16 to accept ordinary sized ice cubes.

While several embodiments of the present invention have been disclosed and modifications thereof suggested, it will be recognized by those skilled in the art that still other changes could be made to the above-identified embodiments of the invention without departing from the broader concepts thereof. It should be understood, therefore, that the invention is not limited to particular embodiments disclosed, but rather, it is entitled to cover all modifications which are within the scope and spirit of the invention, as defined by the appended claims.

What I claim is:

1. In a water toy having a predetermined configuration to eject a stream of water under pressure an improvement comprises:

a reservoir having an opening with a first mouth, said reservoir being capable of holding water;

a first fluid conduit having a first end fluidly connected to said reservoir;

a first valve piston having a first end connected to a second end of said first fluid conduit, said first valve piston having flexible sidewalls and a chamber, said flexible sidewalls and said chamber being adapted to be movable in a linear manner to establish a partial vacuum in said chamber and to also elevate the pressure in said chamber;

a first cylinder having a first end and sidewalls that engage said flexible sidewalls, said first cylinder being movable in a linear, pump-action manner, and in a first direction to effectively enlarge said chamber to fill with water and in a second direction to effectively reduce said chamber and to expel said water therein;

a clamping member having a first hollow with a first end connected to the second end of said first valve piston and locking means for connecting to said first cylinder; and a first valve adapted to move between an open position and a closed position, said first valve being correspondingly moved toward said closed position when said first cylinder is being moved in said first direction, and said first valve being correspondingly moved toward said open position when said first cylinder is being moved in said second direction.

2. The water toy according to claim 1 wherein the first mouth is sufficiently wide to accept ordinary sized ice cubes and further comprising a first cap releasably secured with said reservoir to close off said mouth.

3. The water toy according to claim 2, wherein said reservoir has a second opening with a second mouth smaller than the first mouth and a second cap releasably secured with said reservoir to close off said second mouth.

4. The water toy according to claim 2, wherein said reservoir is sufficiently sealed to hold pressure.

5. The water toy according to claim 2, wherein said first mouth has a diameter dimensioned to accommodate the acceptance of three ranges of ice cubes, with the first range having a diameter of about one inch so as to accept the smallest ordinarily available ice cubes, the second range having a diameter of about one and one-half inches so as to accept the most commonly available ice cubes, and the third range having a diameter of about two inches so as to accept substantially all available ice cubes.

6. The water toy according to claim 1, wherein said first end of said first fluid conduit extends from the lower portion of said reservoir and said second end of said first fluid conduit is at an elevation that is lower than that of its said first end.

7. The pump action water toy according to claim 1 further comprising at least one track member having a first end located proximate said second end of said first conduit means, said at least one track member guiding the movement of said first cylinder and having a stop member for limiting the movement of said first cylinder in said first direction.

8. The pump action water toy according to claim 7 further comprising a graspable member positioned proximate said reservoir and located at said second end of said at least one track.

9. The pump action water toy according to claim 8 further comprising a pedestal member having an upper surface adapted to mate with said reservoir and a lower surface adapted to mate with at least said graspable member.

10. The water toy according to claim 1, wherein said first cylinder has a first centerline and said first valve has a second opening defining its open position and having a second centerline, said first and second centerlines being coaxial.

11. The water toy according to claim 10 further comprising an aiming device having a first end with a central cutout and a second end with at least one cross member arranged within an open cylindrical support, said aiming device being pivotally mounted to said second end of said first cylinder, said aiming device imposing said cross member onto said coaxial centerline when said first end of said aiming device is arranged to be parallel to said coaxial centerline and, conversely, removing said cross member from said coaxial centerline when said first end of said aiming device is arranged to be perpendicular to said coaxial centerline.

12. The water toy according to claim 1, wherein said first valve piston further comprises a spring having an opening, a valve having a shaft with a conical tip on one end, and a valve seat having a central conical portion that leads into a first end having an opening therein, said spring being insertable into said chamber and said shaft of said conical valve being insertable into said spring, said tip of said conical valve resting in said central conical portion of said valve seat and said first end of said valve seat being connected to said second end of said first fluid conduit.

13. The pump action toy according to claim 1, wherein said first valve comprises:

(a) a ball member having a first predetermined diameter;

(b) a first cylindrical member having a hollow with an entrance and an exit portion, said entrance portion having a seating member in which said ball member rests, said seating member having an opening that is closed off when said ball member is resting therein; and (c) a second cylindrical member having an inner chamber with an entrance and an exit portion and at least one cutout in its inner wall, said entrance portion being dimensioned to accept said seating member carrying said ball member and said exit portion being dimensioned to define an orifice having a second predetermined diameter which is less than said first predetermined diameter of said ball member, said at least one cutout being situated in said inner chamber so that water is allowed to pass said ball member and flow to said orifice when said ball member is located in said exit portion of said inner chamber.

14. A water toy according to claim 1, in which said reservoir is sized to receive and contain ice cubes in contacting relation with said water before ejection from said reservoir.

15. A water toy according to claim 14, in which said structure further includes a nozzle outlet from said reservoir and nozzle valve means, and also including water pressurizing means comprising a pump, said nozzle valve means and said pump being sequentially operable to pressurize water in said reservoir and then eject pressurized water from said reservoir through said nozzle outlet, said means to chill being adapted to chill said reservoir water before ejection through said nozzle outlet.

16. A water toy according to claim 15, further comprising a supply of water and ice in water chilling relation within said reservoir.

17. A water toy according to claim 14 in which said structure further includes a nozzle outlet and a pump operable to draw chilled water from said reservoir and then eject chilled water through said nozzle outlet.

18. In a toy water gun including a reservoir adapted to contain water, a pump coupled with the reservoir and a nozzle having a first centerline and being fluidly coupled with at least one of the pump and the reservoir and adapted so as to discharge water from the one along the first centerline, the improvement comprising an aiming device having a first end with a central cutout and a second end with at least one cross member arranged within an open cylindrical support, said aiming device being pivotally mounted on said water gun outwardly of said nozzle at least proximal said first centerline, said aiming device imposing said cross member onto said first centerline when said first end of said aiming device is arranged at a transverse orientation to said first centerline and, conversely, removing said cross member from said first centerline when said first end of said aiming device is arranged to be perpendicular to said first centerline.

* * * * *